United States Patent [19]

Matukura et al.

[11] 4,366,912

[45] Jan. 4, 1983

[54] RUBBER CLOSURE DEVICE FOR VIALS

[75] Inventors: Yoshiharu Matukura, Ikoma; Tokio Kataoka, Kawanishi; Hiroshi Fujisawa, Toyonaka, all of Japan

[73] Assignee: Takeda Chemical Industries, Ltd., Osaka, Japan

[21] Appl. No.: 238,362

[22] Filed: Feb. 25, 1981

[30] Foreign Application Priority Data

Feb. 25, 1980 [JP] Japan ..... 55-22953

[51] Int. Cl.[3] ..... B65D 39/00

[52] U.S. Cl. ..... 215/247; 215/364

[58] Field of Search ..... 215/247, 364

[56] References Cited

U.S. PATENT DOCUMENTS 3,198,368 8/1965 Kirkland et al. ..... 215/247

3,760,969 9/1973 Shimamoto et al. ..... 215/364 X

*Primary Examiner*—Donald F. Norton

*Attorney, Agent, or Firm*—Wenderoth, Lind & Ponack

[57] ABSTRACT

A rubber closure device for closing the mouth of a vial or like vessel comprises an inner closure member having a leg portion adapted to tightly protrude into the mouth, and an overlay closure member overlaying the inner closure member. The inner closure member is made of fluorinated rubber and has a thickness sufficient to exhibit a resistance to chemicals.

11 Claims, 19 Drawing Figures

RUBBER CLOSURE DEVICE FOR VIALS

BACKGROUND OF THE INVENTION

The present invention relates to a rubber closure device for a vial and more particularly to a rubber closure device for sealing the mouth of a vial or like vessel which is resistant to chemicals and can preferably be used in association with a vacuum-filled vial.

The rubber vial closure devices available in the past are made of materials which are resistant to chemicals and have sealing effects or are made of two different materials in order to prevent degradation of the pharmaceutical product contained in the vial, e.g. discoloration, flocculation opalescence or precipitation of the contents or a decrease in potency of the active component. An example of such closure device is disclosed in any one of, for example, Japanese Utility Model Publication Nos. 3893/1951, 17831/1970 and 9095/1972; and French Pat. No. 75922 and is an improved rubber closure device comprising a rubber closure body made of natural rubber or an equivalent material and a thin layer of polypropylene, polyethylene, chloroprene or the like as laminated with the surface of said body which surface is apt to come in contact with a medicament of the vial. However, if this closure device is used in association with a vacuum-filled vial, the rubber component of said body undergoes leakage thereby failing to ensure adequate resistance to chemicals. The other closure devices involving a teflon layer on the surface contacting the medicament of the vial, such as disclosed in any one of Japanese Laid-Open Utility Model Application (Unexamined) No. 41642/1973 and U.S. Pat. No. 3,552,591 serve the purpose of resisting chemicals, but are too expensive and hardly lend themselves to high production, thus being virtually useless for mass-marketing pharmaceutical products.

It has come to the attention of the present inventors that fluorinated rubber is so resistant to chemicals that this property, taken together with other beneficial properties, make it a desirable material for use as vial closure devices. The inventors accordingly have built a vial closure device of this material and submitted it to a series of tests. However, while the closure device of this type was more or less gas-impermeable at atmospheric pressure, it was found to be permeable to gases under reduced pressure as in a vacuum-filled vial. It was also found to be inferior as a closure device in terms of resealing and coring properties. Therefore, the present inventors have made improvements on the device and finally perfected a new closure device invention which withstands use under a decompressed state, for instance, within a vacuum-filled vial.

SUMMARY OF THE INVENTION

Accordingly, the present invention has for its essential object the provision of an improved rubber closure device for use as a pharmaceutical vial which has excellent resistance to chemicals, gas impermeability, resealing capability and excellent coring properties.

Another object of the present invention is to provide an improved rubber closure device of the type referred to above, which is durable and of high quality and which can easily be used to close the mouth of the vial tightly thereby making it most suitable for use as a vacuum-filled vial without being gas permeable.

According to the present invention, an improved rubber closure device for tightly closing the mouth of a vial or like vessel is provided herein which comprises an inner closure member made of a vulcanized synthetic rubber containing fluorine atoms, said inner closure member having a diameter larger than the diameter of the opening at the mouth of the vial or like vessel for sealing the mouth, and an overlay closure member in contact with the inner closure member and made of a vulcanized gas-impermeable synthetic rubber, said overlay closure member being of a thickness sufficient to avoid the flow of fluid therethrough. The inner closure member has a thickness necessary to achieve a sufficient resistance to chemicals and is composed of a disc body having one of its opposite surfaces formed integrally with a plug means which, when the closure device is mounted on the mouth of the vial or like vessel, protrudes into the mouth and tightly contacts the inner peripheral wall defining the mouth. The overlay closure member is so sized as to cover not only the other of the opposite surfaces of the disc body but also the peripheral annular face of the disc body.

BRIEF DESCRIPTION OF THE DRAWINGS

These and other objects and features of the present invention will become apparent from the following description taken in conjunction with preferred embodiments thereof with reference to the accompanying drawings, in which:

FIG. 11(*b*) is a bottom plane view of FIG. 11(*a*);

FIGS. 12(*b*) and 12(*c*) are respectively bottom and plane views of FIG. 12(*a*), FIG. 12(*c*) showing a modification of FIG. 12(*b*);

FIG. 13(*b*) is a bottom plane view of FIG. 13(*a*);

FIG. 14(*b*) is a bottom plane view of FIG. 14(*a*).

DETAILED DESCRIPTION OF THE EMBODIMENTS

Figure 1:
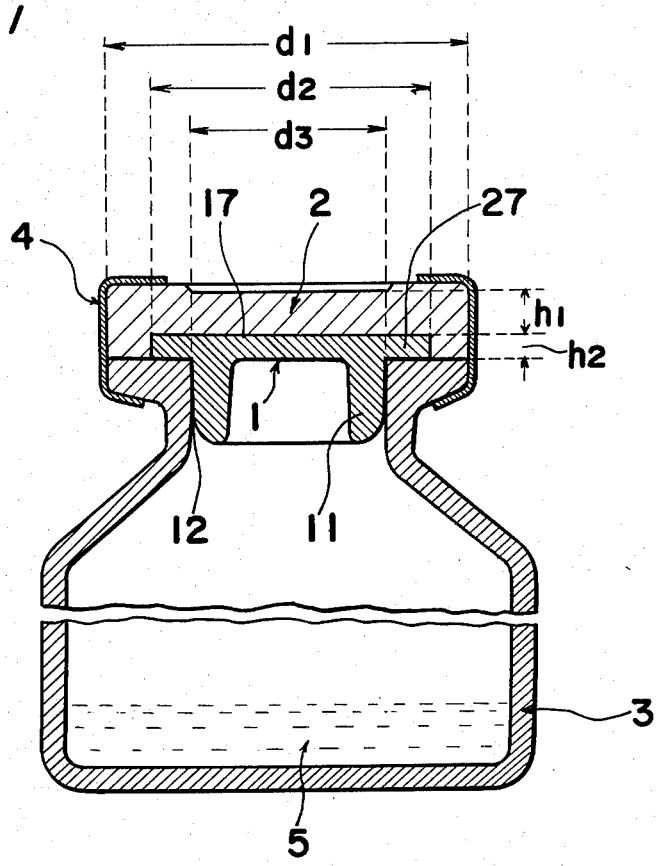
FIG. 1 is a side cross-sectional view, partially broken away, of a vial having its mouth closed by a rubber closure device of a first embodiment of the present invention.
Figure 2:
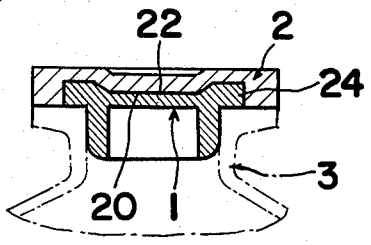
FIGS. 2 to 11(*a*) are side sectional views of a rubber closure device according to the second to eleventh embodiments of the present invention, respectively.
Figure 3:
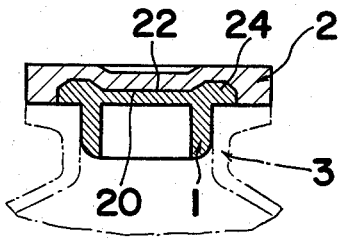

Before the description of the present invention proceeds, it is to be noted that like parts are designated by like reference numerals throughout the accompanying drawings.

Referring to FIG. 1 which is a diagrammatic view illustrating an embodiment of the present invention, the vial closure device according to the present invention comprises a fluorinated rubber inner closure member or closure body 1 having a pendant or leg portion 11 adapted to fit into an open end or mouth 12 of a vial 3 and having a diameter d2 larger than the inside diameter d1 of the vial mouth 12, and a gas-impermeable synthetic rubber overlay closure member 2 superimposedly laminated onto the body 1.

The overlay closure member 2 preferably has a thickness h1 required to avoid the flow or permeation of fluid, such as gas and/or liquid, therethrough, whereas the closure body 1 preferably has a thickness h2 required to store a chemical-resistant medical solution and also to avoid any possible curing. Experiments have shown that the thickness h1 and the thickness h2 which are within the range of 2 to 5 mm and not smaller than 300μ, respectively, are preferable. It has also been found that, if the closure device is manufactured by vulcanizing the body 1 and the member 2 together, the rate of production of defective closure devices can be minimized.

The term "fluorinated rubber" of the closure body 1 means any synthetic rubber including fluorine atoms in its molecule. Thus, the fluorinated rubber may, for example, be one of elastomers in $CH_2CF_2$-$C_3F_6(C_3F_5H)$ series (e.g. such as commercial products being sold in the names of Viton ®, Du Pont; Daiel ®, Daikin), elastomers in the fluoro-silicone series (e.g. such as commercial products being sold in the name of Silastic ® LS, Dow Corning), elastomers in the $C_2F_4$-$C_3H_6$ series (e.g. such as commercial products being sold in the name of Aflass ®, Asahi Glass), elastomers in the phosphazene series (such as commercial products being sold in the name of PNF ®, Firestones), elastomers in the $C_2F_4$-$C_2F_3OCF_3$ series (e.g. such as commercial products being sold in the name of Carlez ®, Du Pont), etc. Accordingly, the closure body 1 is manufactured from such an elastomer. Among the above-mentioned fluorine-containing elastomers, the $CH_2CF_2$-$C_3F_6(C_3F_5H)$ elastomers and $C_2F_4$-$C_3H_6$ elastomers are especially preferable to be used for the closure body. These elastomers can be formed into the vial closure device of the present invention in the following and other manners. By way of example, one of the above elastomers, or a mixture thereof, is supplemented with a vulcanizing or curing agent, a stabilizer, a filler, or the like, and the compound thereof is subjected to primary curing step and a second curing step, both of which may be performed in the conventional processes. Thus, for example, a $C_2F_4$-$C_3H_6$ elastomer is cured primarily at 150° to 170° C. for 5 to 20 minutes and, then, secondarily at 150° to 250° C. for 3 to 30 hours. Preferred conditions are 10 minutes at 170° C. for the primary step and 20 hours at 200° C. for the second step. The fluorinated rubber closure body 1 is preferably made of the above-mentioned materials but any other suitable similar material may be selected for the intended application.

Figure 13:
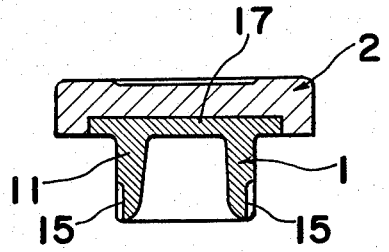
FIG. 13(*a*) is a view similar to FIG. 12(*a*), but according to a thirteenth embodiment of the present invention.
Figure 14:
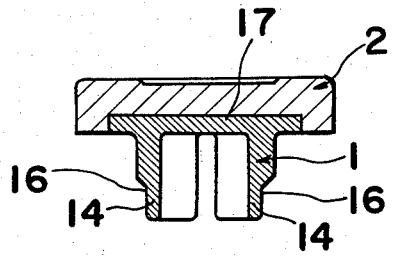
FIG. 14(*a*) is a view similar to FIG. 12(*a*), but according to a fourteenth embodiment of the present invention.
Figure 13B:
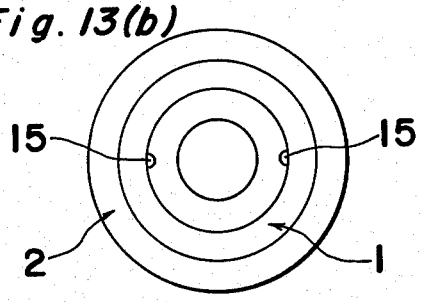
Figure 14:
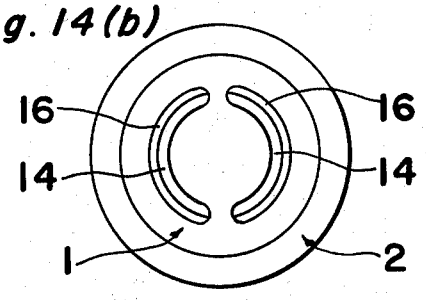

The pendant or plug portion 11 of the vial closure device which is to be fitted into the open end 12 of a vial 3 may be of any configuration only if it is able to function as a centering means for the insertion of the closure device into the vial. The elevation (height) of the pendant portion 11 depends on the inside diameter of the vial mouth opening 12 but generally speaking, the elevation is normally about 0.1 to 3 cm and preferably about 0.3 to 2.0 cm. The pendant portion 11 is usually continuous but may be a discontinuous one consisting of two or more members 14, 14 as illustrated in FIG. 14(*a*). Alternative forms of the pendant portion include the one having a groove 15 partially extending along its length as shown in FIG. 13 and the one having a recess 16 as illustrated in FIG. 14(*a*). These grooved, recessed or otherwise relieved configurations 15, 16 are especially suited as closure devices for vacuum-filled vials.

Figure 4:
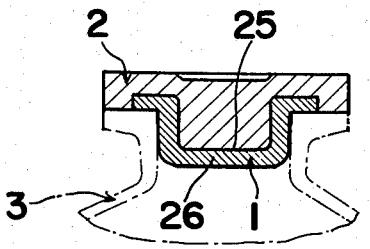
Figure 5:
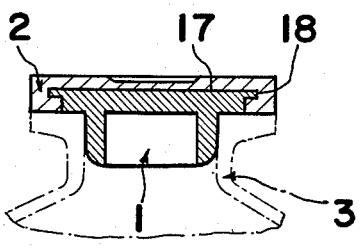
Figure 6:
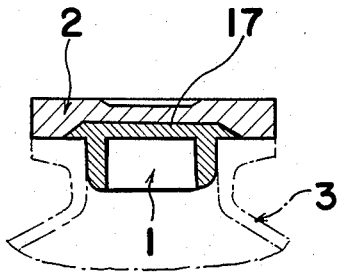
Figure 7:
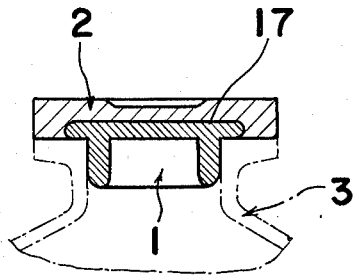
Figure 8:
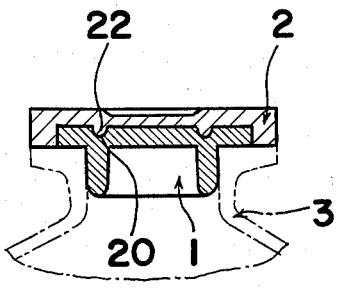
Figure 9:
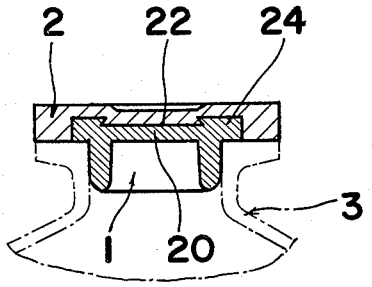
Figure 10:
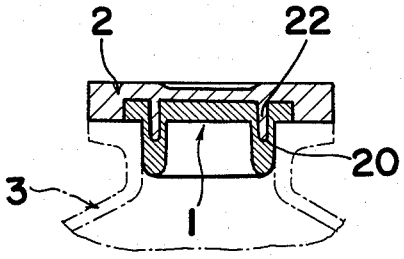
Figure 11:
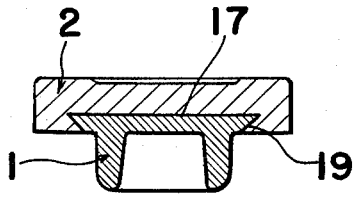
Figure 11:
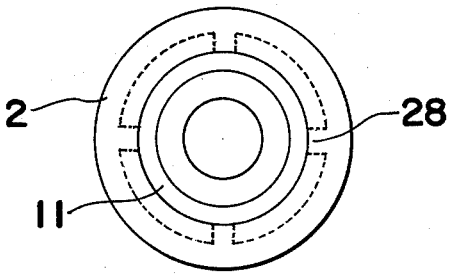
Figure 12:
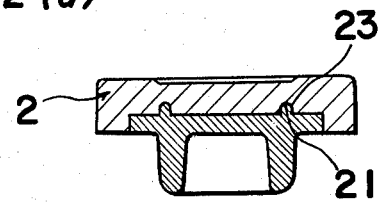
FIG. 12(*a*) is a side sectional view of the rubber closure device according to a twelfth embodiment of the present invention.
Figure 12:
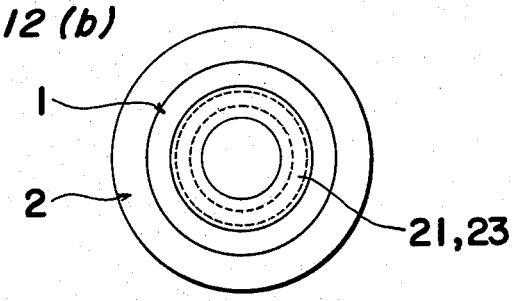
Figure 12:
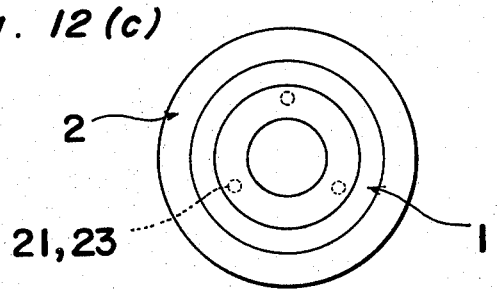

The top surface of the fluorinated rubber closure body 1 may be of any configuration as long as it does not interfere with lamination with the gas-impermeable synthetic rubber of the overlay closure member 2. Preferred configurations of the top surface include simple planar ones such as those illustrated in FIGS. 1, 5, 6, 7, 11, 13(*a*) and 14(*a*), for instance, a planar but flanged one 18 as illustrated in FIG. 5 and a bevelled one 19 as illustrated in FIG. 11(*a*), for instance. These configurations are desirable in that they provide for an increased resistance to separation of the two rubber members 1 and 2 from each other. Moreover, as shown in FIGS. 2, 3, 8, 9, 10 and 12, the body 1 may have its top surface adjacent the member 2 with one or more recesses 20 or projection 21 while the member 2 has its inside surface adjacent the body 1 with a corresponding number of projections 22 or recesses 23 complemental in shape to the recesses or projections on the top surface of the body 1, so that the body 1 and the member 2 can be united together in a laminated state. The partially recessed portions 20 of the bodies illustrated in FIGS. 8, 9 and 10, for example, and the locally projecting portion 21 illustrated in FIG. 12(*a*), for example, offer increased resistances to separation of the two rubber members. Such projections or recesses may be either continuous as illustrated in FIG. 12(*b*) or discontinuous as shown in FIG. 12(*c*). Also, the periphery of the body 1 may also be cog-shaped 28 as shown in FIG. 11(*b*). Further, a marginally thickened portion 24 of the body 1 illustrated in FIGS. 2, 3 and 9, for example, are desirable from strength and other points of properties thereof. In addition, as shown in FIG. 4, the pendant portion 11 may be formed by recessing a central portion 25 of the body 1 so as to protrude to define a single pendant portion 26. The single pendant portion 26 such as shown in FIG. 4 exhibits a preferred strength therefor.

The outer surface of the top portion 27 of the rubber closure body 1 must have a diameter d2 larger than the inside diameter d3 of the vial mouth opening and preferably smaller than the outside diameter d1 of the open end of the vial 3. The particularly preferred diameter d2 of the closure body 1 lies approximately half-way between the inside diameter and outside diameter of the open end of the vial 3 as shown in FIG. 1 and may range from $\frac{1}{3}$ to $\frac{2}{3}$ of the distance from either of the extremes of the open end. This is because, when the diameter d2 of the top face of the body 1 is larger than the diameter d3, there is no possibility that the closure device may be drawn into the vial 3 when vacuum is introduced into the vial 3, and when the diameter d2 of the top face of the body 1 is smaller than the diameter d1, the closure device held in position to close the vial mouth can be fixedly sealed to the vial 3 by the use of a metal or synthetic seal ring 4 as shown in FIG. 1.

In addition, the overall thickness of the body 1 is preferably within the range of 300μ to 1.3 mm. If it is smaller than 300μ, the body 1 may lack a sufficient resistance to chemicals whereas, if it is larger than 1.3 mm, the coring property thereof against a piercer may be lowered. When the body 1 is formed by vulcanizing the material, it has a sufficient rigidity and is less susceptible to formation of pin-holes and nearly free from such problems as associated with breakage and gas permeability.

On the fluorinated rubber closure body 1, there is superimposed an overlay closure member 2 made of gas-impermeable synthetic rubber which provides no-space therebetween. The term 'gas-impermeable synthetic rubber' of the overlap closure member 2 means any synthetic rubber which is impermeable to moisture, gases or liquid. Thus, such synthetic rubbers as butyl rubber, epichlorohydrin rubber, ethylene-vinyl acetate rubber, etc. can be successfully employed for the overlay closure member 2, although butyl rubber is especially beneficial among them. Species of the butyl rubber include regular butyl rubber, chlorinated butyl rubber, brominated butyl rubber, etc. with regular butyl rubber being most suitable.

The overlay closure member 2 of gas-impermeable synthetic rubber is so sized as to cover not only the top face of the body 1 but also the annular peripheral face of the same body 1 and is provided to avoid access of fluid to the body 1 and also for resealing after an injection needle pierced into the vial 3 has been removed. The thickness h1 of this member 2 is preferably within the range of 2 to 5 mm. It has been found that, if the thickness h1 is smaller than 2 mm, both the gas impermeability and the resealing capability are lowered. Also, if the member 2 is formed by vulcanizing the material therefor, the member 2 can exhibit a sufficient physical strength and is less susceptible to formation of pinholes.

The gas-impermeable synthetic rubber overlay closure member 2 may be laminated with the fluorinated rubber closure body 1 to manufacture a vial closure device of the present invention in such a manner, for example, that the secondarily cured fluorinated rubber closure body 1 is set in a mold, a molding compound containing the above-mentioned gas-impermeable synthetic rubber is then filled atop of the closure body 1 with or without application of an adhesive, and finally, the assembly is cured by heating in the mold at an elevated pressure so as to obtain a rubber closure device of the present invention.

The above-mentioned adhesive to be provided between the body 1 and the member 2 is preferably a silicone-type adhesive agent. The curing conditions required for each of the body 1 and the member 2 may be those conventionally employed for the vulcanization of butyl rubber, e.g. 5 to 30 minutes at about 150° to 180° C. and preferably 10 to 20 minutes at 160° to 170° C.

The vial closure device according to the present invention obtained by the above operation is not only resistant to chemicals but completely prevents infiltration of moisture and gases therethrough. Especially when the closure device of the present invention is used in association with a vacuum-filled vial, the device completely inhibits entry of moisture from the outside and ensures a high degree of gas seal for the vial 1 so that the pharmaceutical product 5 within the vial container can be preserved for a long time without fear of degradation. In addition, the closure device of the present invention offers an improved resealing action, the action required after a piercing stroke of an injection needle, which resealing action is necessary to prevent leakage of the contents, and there is substantially no coring problem following piercing with a needle. The vial closure device of the present invention lends itself better to an automatic capping process and provides for a decreased incidence of rejects.

The drugs and pharmaceuticals for which the vial closure device of the present invention is particularly beneficially applied are those which would be degraded if a conventional closure device were to be employed, where sparingly soluble solid preparations are used, and where various types of drugs which would react with atmospheric oxygen, and so on are used. As examples of such drugs there may be mentioned ascorbic acid, ampicillin sodium, isoniazide, isophene-insulin, insulin, influenza vaccine, dried antidotes (e.g. dried snake venom), sulfocillin sodium, cefacetrile sodium, cefazolin sodium, carbenicillin sodium, cefotiam hydrochloride, cefsulodine, cephalothin sodium, etc. FIG. 1 shows a vaccum-filled vial employing a rubber closure device of this invention, which vial contains a mixture 5 of 7β-[2-(2-aminothiazol-4-yl)acetamido]-3-[[[1-(2-dimethylaminoethyl)-1H-tetrazol-5yl]thio]methyl]-ceph-3-em-carboxylic acid dihydrochloride and sodium carbonate.

Therefore, the present invention thus provides a very useful rubber vial closure device having improved actions and effects, as shown by the following Examples.

EXAMPLE 1

The closure device of the present invention (FIG. 1) and a control fluorinated rubber closure device of the same dimensions are compared. First, a desiccant ($CaCl_2$, 1 gram) is taken in vials and capped with the rubber closure devices in a vacuum. A total of 20 test samples of vials are prepared and stored in a desiccator maintained at a constant relative humidity with a saturated aqueous electrolyte solution (storage conditions: 40° C., 90% R.H.). The results for the moisture permeability of vials are as shown in Table 1.

TABLE 1

| Closure device | Moisture permeability Gained amount of water (average of total samples) after 3 Months at 40° C., 90% R.H |
|---|---|
| The present invention | 0.6 mg |
| The comparison of mere fluorinated rubber | 7.3 mg |

EXAMPLE 2

The closure device of the present invention (FIG. 1) and the control fluorinated rubber device of the same dimensions are compared. First, the vials are filled with one-half of its capacity of water, the closure devices (20 samples each) are turned and tightened to close, and a quantity of air equivalent to the volume of head space is injected with an injection syringe and the samples are examined for water leaks after withdrawal of the needle. The results for resealability of vials are as shown in Table 2.

TABLE 2

| Closure device | Water leak (permeability) Ratio of number of leaked samples to total number of samples |
|---|---|
| The present invention | 0/20 |
| Fluorinated rubber | 20/20 |

EXAMPLE 3

The closure device of the present invention (FIG. 1) and the control fluorinated rubber device of the same dimensions are compared. The vials are capped with the closure devices (100 samples each) which were turned and tightened. Thus, each device is pierced with an injection needle and the same is examined for the presence of visible rubber fragments. The results of the coring of these vials are as shown in Table 3.

TABLE 3

| Closure device | Coring Ratio of number of contaminated samples to total number of samples |
|---|---|
| The present invention | 10/100 |
| Fluorinated rubber | 90/100 |

Although the present invention has fully been described in connection with the preferred embodiments thereof, it is to be noted that various changes and modifications are apparent to those skilled in the art. Such changes and modifications are to be understood as included within the true scope of the present invention unless they depart therefrom.

What is claimed is:

1. A rubber closure device for closing the mouth of a vial or like vessel which comprises an inner closure member having a thickness required to achieve a sufficient resistance to chemicals which may be contained in the vial and a diameter larger than the diameter of the opening of the mouth, said inner closure member being made of vulcanized synthetic rubber containing fluorine atoms, said inner closure member being composed of a disc body having one of its opposite surfaces formed integrally with a leg means which, when the closure device is held in position to close the mouth, protrudes into the mouth and contacts tightly the inner peripheral wall defining the mouth, and an overlay closure member overlaying in contact with the inner closure member and made of vulcanized gas-impermeable synthetic rubber, said overlay closure member having a thickness sufficient to avoid the flow of fluid therethrough and being so sized as to cover both the other of the opposite surfaces of the disc body and the peripheral face of the disc body.

2. A device as claimed in claim 1, wherein said inner closure member and said overlay closure member are bonded together by the use of an adhesive.

3. A device as claimed in claim 2, wherein said adhesive is a silicone type adhesive.

4. A device as claimed in claim 1, wherein said inner closure member has at least one projection formed on said other of the opposite surfaces thereof, and said overlay closure member has a recess formed on one surface thereof facing the inner closure member, said projection and said recess being in complemental in shape to each other, said inner closure member and said overlay closure member being connected together with said projection received in said recess.

5. A device as claimed in claim 1, wherein said vulcanized synthetic rubber containing the fluorine atoms is a fluorinated rubber elastomer.

6. A device as claimed in claim 1, wherein said gas-impermeable synthetic rubber is butyl rubber.

7. A device as claimed in claim 1, wherein said leg means is of a ring-shape.

8. A device as claimed in claim 1, wherein said leg means is of a cylindrical shape.

9. A device as claimed in claim 1, wherein said overlay closure member has a thickness within the range of 2 to 5 mm.

10. A device as claimed in claims 1, 5, 6 or 9, wherein said inner closure member has a thickness within the range of 300$\mu$ to 1.3 mm.

11. A device as claimed in claim 1, wherein said inner closure member has a diameter smaller than the outer diameter of the mouth.

* * * * *